United States Patent [19]

Miller

[11] Patent Number: 4,519,374

[45] Date of Patent: May 28, 1985

[54] COMPOUND ARCHERY BOW

[76] Inventor: Larry D. Miller, 852 Dressler La., Rochester, Mich. 48063

[21] Appl. No.: 395,728

[22] Filed: Jul. 6, 1982

[51] Int. Cl.[3] ..... F41B 5/00

[52] U.S. Cl. ..... 124/23 R; 124/DIG. 1

[58] Field of Search ..... 124/23 R, 24 R, 90, 124/86, 80

[56] References Cited

U.S. PATENT DOCUMENTS

| | | | |
|---|---|---|---|
| 3,486,495 | 12/1969 | Allen | 124/24 R |
| 3,851,638 | 12/1974 | Alexander | 124/90 X |
| 4,060,066 | 11/1977 | Kudlacek | 124/23 R |
| 4,365,611 | 12/1982 | Nishioka | 124/24 R |
| 4,368,718 | 1/1983 | Simonds et al. | 124/DIG. 1 X |

*Primary Examiner*—Richard J. Apley
*Assistant Examiner*—William R. Browne
*Attorney, Agent, or Firm*—Barnes, Kisselle, Raisch, Choate, Whittemore & Belknap

[57] ABSTRACT

A compound bow with primary and secondary pulleys at the distal ends of the flexible limbs designed to reduce the draw force at the end of the draw. Pulley shape is designed to alter the force-draw curve to provide a flat plateau at the maximum draw which drops off again to the holding draw force. Draw length is controlled by curvature contour at segments of the secondary cable pulleys to achieve short, medium or long draw lengths with selective pulley segments which can be attached to a base primary pulley. A draw string pulley has a first perimetric section which is circular and a second connecting curved perimetric section which has a progressively decreasing radii from each end to the center with radii less than that of the first section. In some embodiments, three or four zones are provided. These zones can be created with add-on plates secured to a basic pulley.

11 Claims, 22 Drawing Figures

COMPOUND ARCHERY BOW

FIELD OF INVENTION

The invention is related to archery bows with overcenter pulleys which provide a lower draw pull at the end of the draw to facilitate aiming of the bow and relieve strain on the drawing arm.

BACKGROUND OF INVENTION

Since the advent of the compound archery bow, exemplified by the Allen bow disclosed in Allen U.S. Pat. No. 3,486,495, issued Dec. 30, 1969, there has been an increasing adoption of the compound bow by hunters and archery enthusiasts. The overcenter action of the pulleys in a compound bow relieves the pulling force and enables an archer to hold an arrow in position with less strain on the arms. This insures better aim while not reducing the overall stored energy in the bent row.

It is an object of the present invention to provide an improved pulley system which has the advantages of a compound bow but which will store more energy in the bow limbs without increasing the maximum draw force.

More stored energy means a faster arrow and a faster arrow is more accurate and needs less vertical compensation for drop in flight. It is a further object to provide a pulley system which is particularly adapted to variations in the total draw so that an archer can select the desired draw length.

The reference Allen U.S. Pat. No. 3,486,495 illustrates oval-shaped pulleys but the shape of these pulleys, while achieving the eccentricity desired, does not produce a faster arrow. It is an object of the present invention to provide pulley shapes which result in more stored energy and a faster arrow.

Additional objects and features of the invention will be apparent in the following description and claims in which the invention is described and embodiments shown and described in sufficient detail to enable persons skilled in the art to practice the invention, all in connection with the best mode presently contemplated for the invention.

BRIEF DESCRIPTION OF THE DRAWIGS

Drawings accompany the disclosure and the various views thereof may be briefly described as:

FIG. 1, a side elevation of a bow with the improved pulley design;

FIG. 2, a graph showing draw length plotted against draw force;

FIG. 3, an enlarged view of a compound bow pulley on a bow limb tip.

FIG. 4, a view of compound pulleys on upper and lower bow limbs in the at-rest position.

FIG. 5, a view of the pulleys of FIG. 4 in a drawn position;

FIG. 6, a draw position related to point A in FIG. 2;

FIG. 7, a draw position related to point B in FIG. 2;

FIG. 8, a draw position related to point C in FIG. 2;

FIG. 9, a draw position related to point D in FIG. 2;

FIG. 10, a view of a primary drawstring compound pulley;

FIG. 11, a view of a secondary compound pulley for the upper limb pulley to provide a long draw;

FIG. 12, a view of a second configuration of a secondary pulley to provide a medium draw;

FIG. 13, a view of a secondary pulley to provide a short draw;

FIG. 14, a view of a primary pulley for upper and lower limbs with a secondary pulley;

FIG. 15, a secondary upper pulley configuration created by an add-on element to provide a long draw;

FIG. 16, a lower pulley configuration opposite to that shown in FIG. 15 to provide a long draw;

FIG. 17, a view of an add-on plate utilized in FIGS. 15 and 16;

FIG. 18, a view of a symmetrical add-on plate for upper and lower base limbs to provide a medium draw;

FIGS. 19 and 20, views of upper and lower pulley sets for a short draw;

FIG. 21, a view of the add-on plate used in FIG. 18; and

FIG. 22, a view of the add-on plate used in FIGS. 19 and 20.

DETAILED DESCRIPTION OF THE INVENTION AND THE MANNER AND PROCESS OF USING IT

Figure 1:
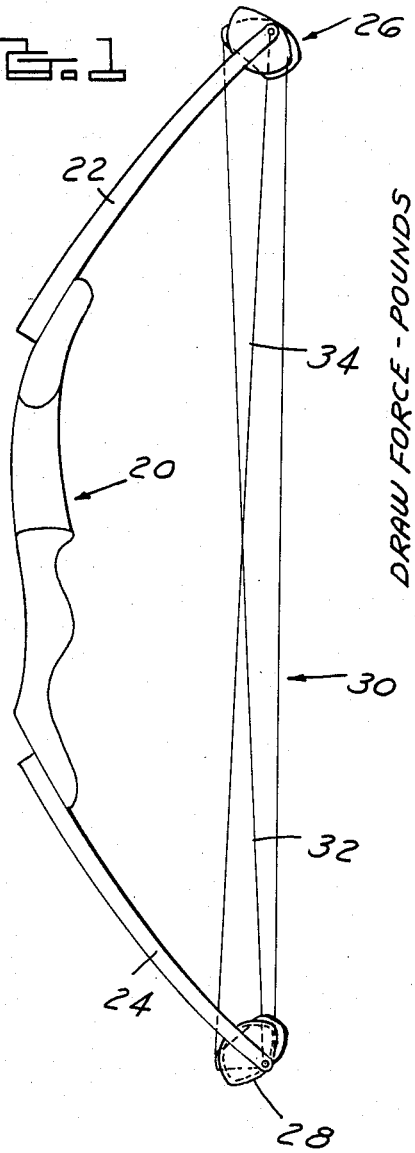

In FIG. 1, a compound bow is illustrated with a bow handle 20, upper and lower bow limbs 22 and 24, compound pulleys 26 and 28 rotatably mounted on the upper and lower bow limbs, and bow cables which include a drawing string 30, a cable run 32 anchored at the lower bow limb and a cable run 34 anchored at the upper bow limb. Each compound pulley can be said to be composed of a primary pulley and a superposed secondary pulley. The primary pulley carries the drawstring in each case.

Figure 2:
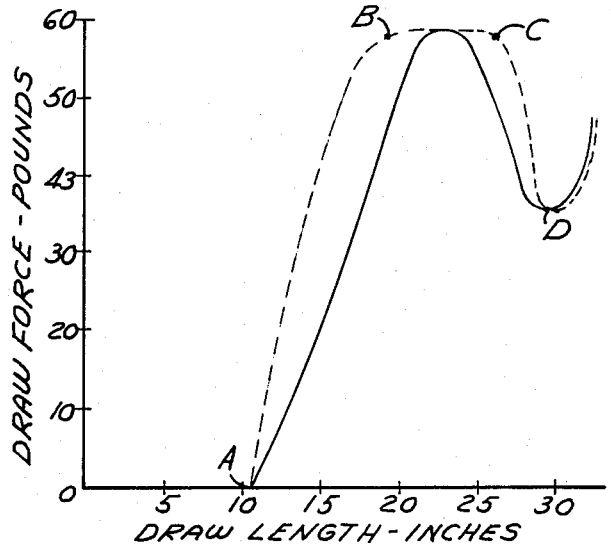

An object of the present invention is to provide a pulley combination which increases the stored energy of the bow during a draw without increasing the draw force. This is illustrated graphically in FIG. 2 where the solid line curve shows the force-draw curve, draw length in inches against draw force in pounds, for a standard compound bow. This ellipsoidal curve has a peak at one point only. The dotted durve in FIG. 2 shows a drawforce curve for a pulley of the present invention where the curve levels off at the top of the draw force and widens significantly in a plateau before drop-off. The area below the curve represents the total stored energy and this is significantly greater under the dotted curve. Further reference will be made to this feature in connection with FIGS. 6 to 9.

Figure 3:
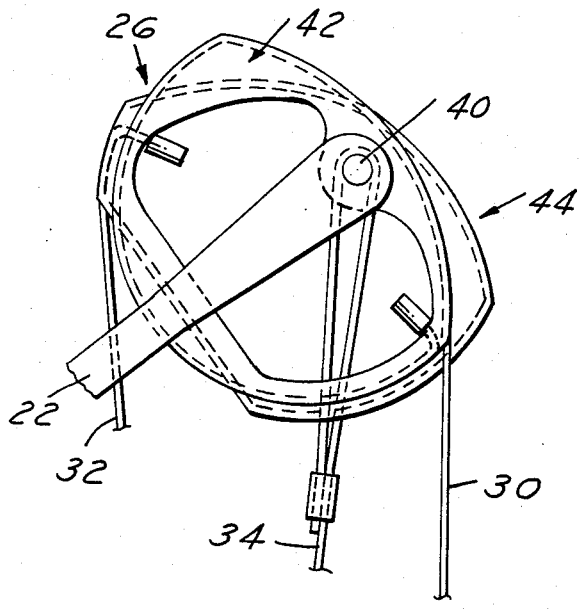
Figure 4:
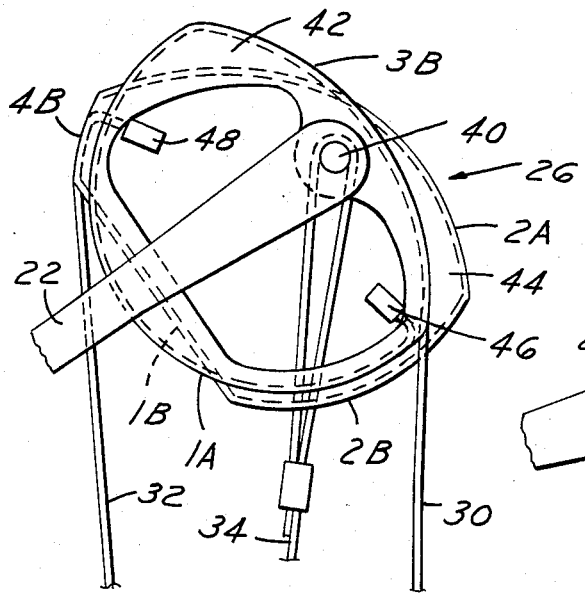
Figure 5:
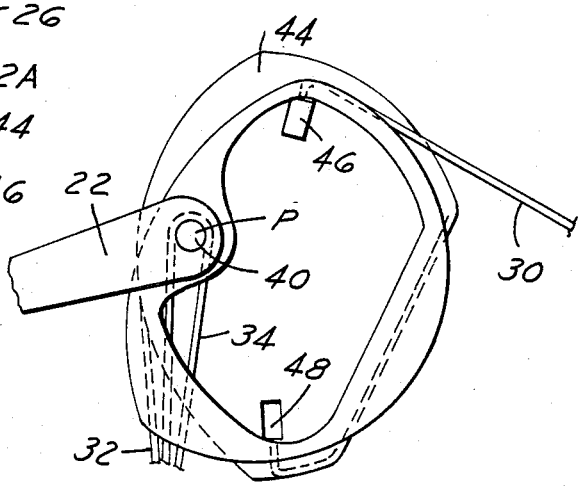
Figure 5:
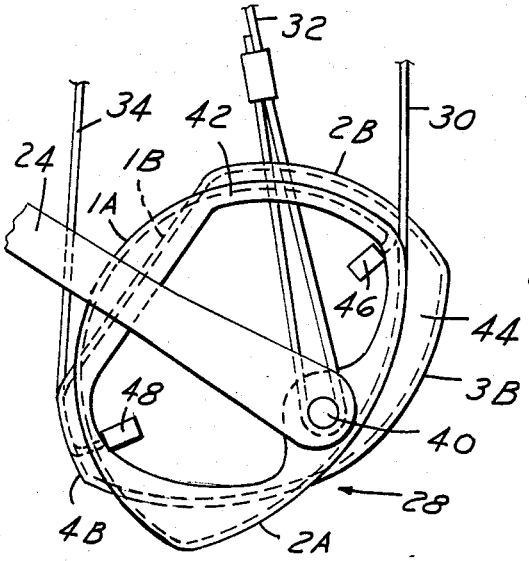
Figure 5:
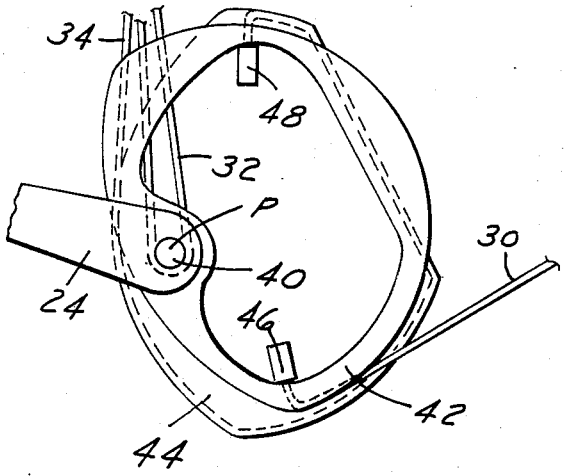

In FIGS. 3 to 5, an exemplary pulley design is illustrated with a configuration consistent with the present invention concept. In FIG. 3, an upper bow limb 22 is illustrated having a pivot and anchor pin 40 and a compound pulley composed of pulleys 42 and 44. These pulleys, if made from separate flat plates, are in face-to-face contact. However, they are preferably molded as one integral piece with pulley runs of each in separate planes. These same parts are shown in FIGS. 4 and 5. The pulley assembly at the top bow limb is always symmetrically opposite to that at the bottom bow limb. In FIGS. 4 and 5, the parts are identical but in a different position of rotation. Specifically, in FIG. 4, the pulleys are shown in an at-rest (non-draw) position. In FIG. 5, the pulleys are shown in a full draw position.

The draw string 30 passes around the pulley 42 to an anchor point 46. This draw string pulley can be referenced as the primary pulley. Cable run 32 anchors at 48 on the secondary pulley 44 at the upper assembly. Cable run 34 anchors at 48 on secondary pulley 44 in the lower assembly.

As shown in FIGS. 4 and 5, the draw string 30 passes around primary pulleys 42 to the anchor point 46 in the non-draw position. In the drawn position (FIG. 5) the draw string has unwrapped from primary pulley 42 almost to the anchor point 46 at each bow limb 22 and 24. The cables 32 and 34 are wrapped around secondary pulleys 44, in the draw motion, from an area near the anchor points 48 to a point near the anchor and pivot points 40. In FIG. 5, the cables 32 and 34 are essentially tangential to the pulleys 44 opposite the anchor and pivot points 40.

In FIGS. 6 to 9, related to the graph of FIG. 2, a schematic presentation with pivot and anchor point 50 and slightly modified primary and secondary pulleys 54 and 52 is shown. The bowstring is shown at 60. Cable 62 is comparable to cable 32 in the previous figures and cable 64 is comparable to cable 34.

Figure 6:
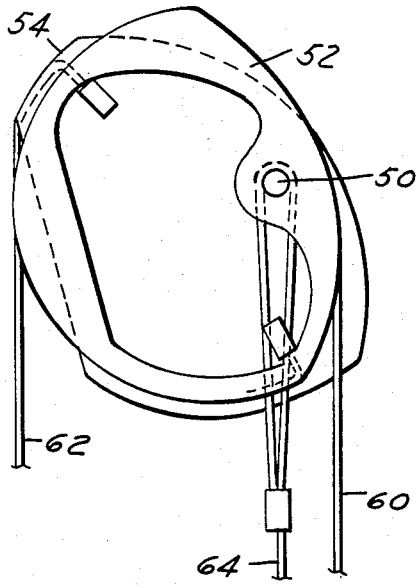
Figure 7:
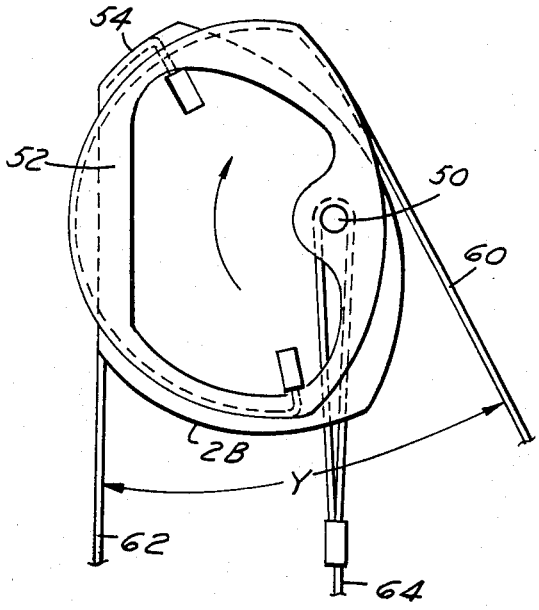

With reference to FIG. 2, position A on the graph compares to the illustration in FIG. 6, the at-rest or undrawn position of the bowstring. Position B on the full line curve of FIG. 2 is a partially drawn position as illustrated in FIG. 7. In the graph, the horizontal base line represents draw distance (d) and the vertical line represents a draw force. The position B on the curve is about at the top draw force where the curve levels out. The pulleys are rotating in a clockwise direction at the upper limb around the pivot pin 50. Further draw at force B takes the curve to position C of FIG. 2, illustrated by the parts in FIG. 8, and the draw force then drops off to the full draw position D as illustrated by the parts in FIG. 9.

In FIG. 2, the dotted curve shows the conventional curve of a compound bow. Thus, it can be seen that the area under curve ABCD is significantly larger than the area under the conventional curve and the stored energy is thus greater. Thus, the design of the pulleys is to achieve a long flat at the top of the curve (B to C) to increase the stored energy.

In FIGS. 10 to 13, diagrammatic views of a basic primary pulley and modified draw string secondary pulleys are illustrated and various arcs of the pulleys are designated in connection with function.

Figure 10:
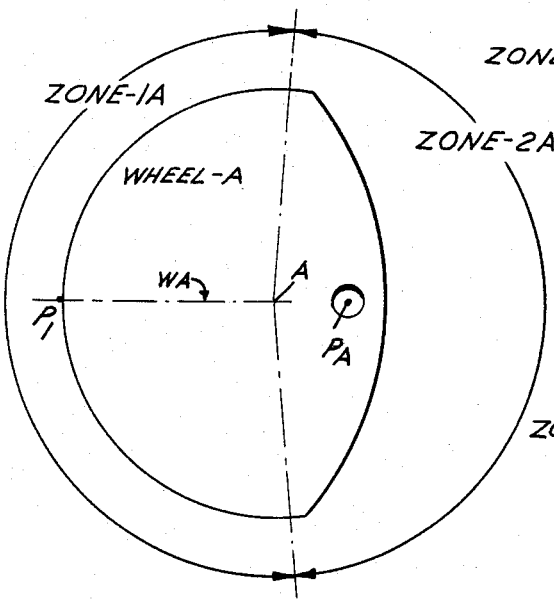
Figure 11:
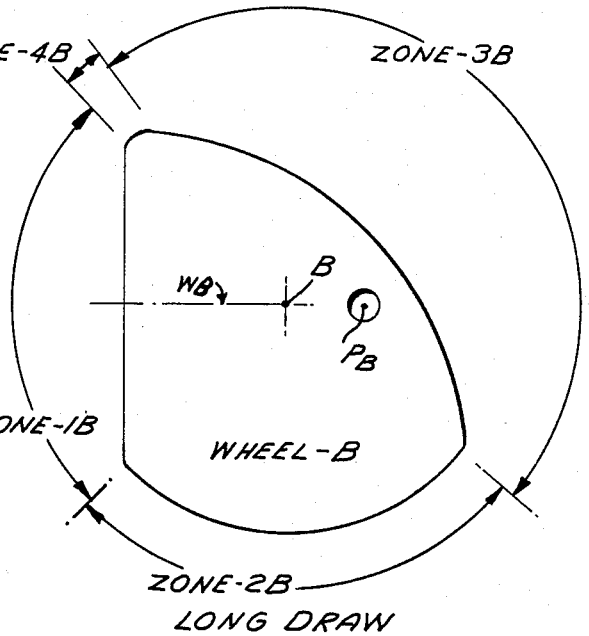
Figure 12:
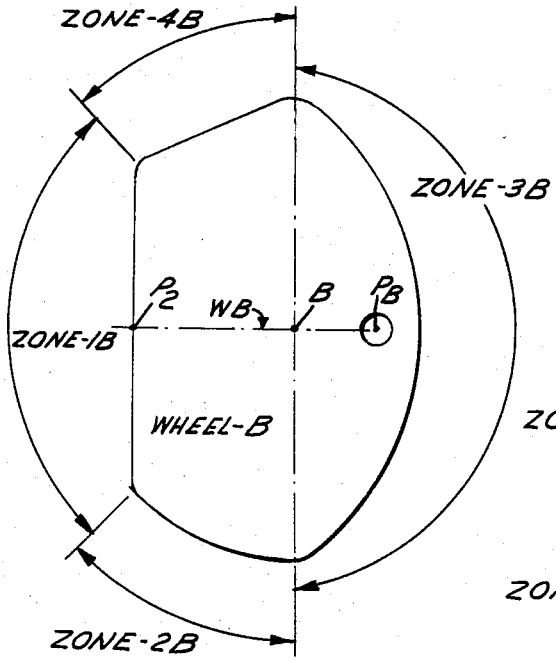
Figure 13:
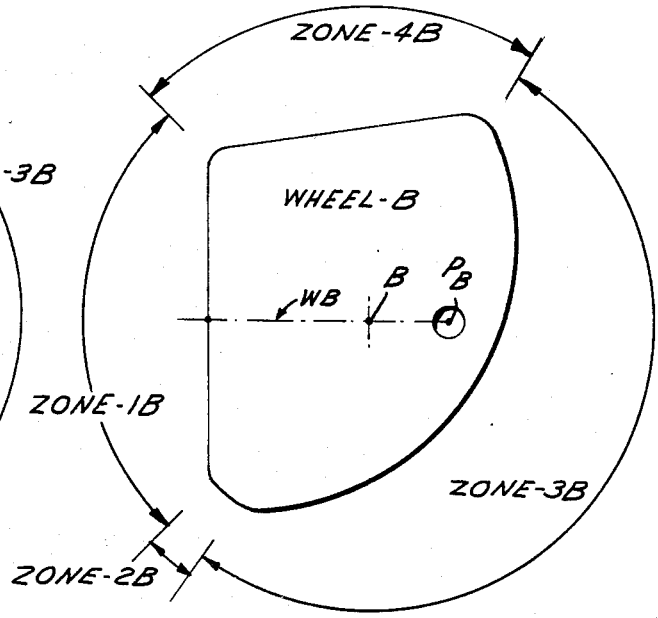

The upper and lower pulley assemblies are, as has been seen, each composed of two pulleys or wheels, a primary draw string pulley, designated wheel A in FIG. 10 and a secondary cable pulley designated wheel B in FIGS. 11, 12 and 13.

Wheel A, the primary pulley, is divided into two zones (FIG. 10). Each zone occupies approximately one-half of the 360° perimeter. The shape of the perimeter in Zone 1A is curved on a substantially constant radius as measured from the wheel center A. The shape of the perimeter within Zone 2A has a lesser curvature (about half of Zone 1A) and has a radii, measured from wheel center A to any point in the arc, which are less than the radius of Zone 1A. For example, the distance from point A to the midpoint of arc 2A is about one-half of the radius of arc 1A.

Reference line WA passes through wheel center A and a point ($P_1$) midway on the perimeter of Zone 1A. Pivot point $P_A$ is located on the reference line WA relatively close to the perimeter in Zone 2A.

The perimeter of wheel B (secondary pulley) is divided into four zones (FIGS. 11, 12 and 13). Zone 1B in FIG. 11 occupies approximately one-quarter of the wheel's full 360°. The shape of the perimeter in this zone (1B) is substantially flat. Zone 3B on the opposite side of pivot point $P_B$ occupies approximately one-half of the wheel's full 360° and has an outer perimeter shape which is curved and has a radial distance as measured from the wheel center B to any point on the perimeter which is less than the radial distance in an essentially circular Zone 2B.

Zones 2B and 4B utilize the remaining one-quarter of the wheel's 360°. Zone 2B is located between Zones 1B and 3B below the pivot point $P_B$. Zone 4B is located between Zone 1B and Zone 3B above the pivot point.

For an archery bow with a relatively long draw length, Zone 2B occupies substantially a full 90° and Zone 4B is essentially nil as in FIG. 11. For an archery bow with a short draw, Zone 2B is essentially nil and Zone 4B utilizes the full 90° as in FIG. 13. For an archery bow with a medium draw length, Zone 2B and Zone 4B each utilize approximately 45° of the wheel's 360° as in FIG. 12.

The outer perimeter of secondary cable Wheel B within Zone 2B has a shape which is curved and has a substantially constant radius as measured from wheel center B to the perimeter. The perimeter of wheel B within Zone 4B has a surface shape which is unimportant because it is not used to wrap or unwrap cable but would most efficiently be a flat shape.

The reference line WB passes through wheel center B and a point ($P_2$) located midway on the perimeter of Zone 1B.

Pivot point $P_B$ is located on reference line WB approximately one-half the distance from wheel center B to the perimeter in Zone 3B.

In the pulley assembly, primary and secondary wheels A and B are located relative to each other with reference lines WA and WB in line and with wheel centers A and B coinciding. (Zones 1A and 1B are on the same side.)

The upper and lower pulley assemblies for the upper and lower limbs of the bow are the same shape (for a given draw length) except symmetrically opposite, with the upper assembly having Zone 2B located below the pivot point (in the undrawn position) and with the lower pulley assembly having Zone 2B located above the pivot point.

Operation of the bow

Figure 9:
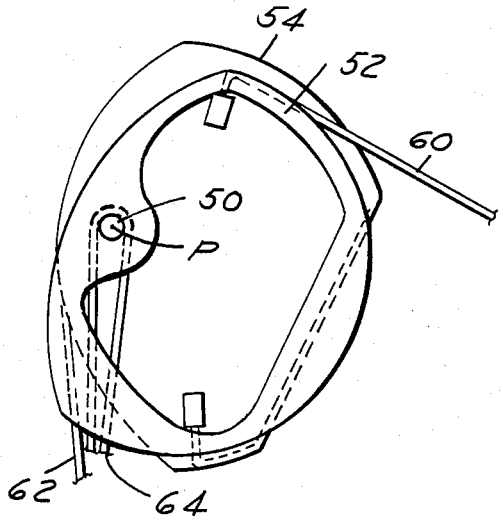

With reference to FIGS. 4 and 9, as well as FIGS. 10 to 13, as the bowstring 30 is drawn toward the archer, cable 30 unwraps from the upper and lower wheels A (primary pulleys) causing the pulley assemblies to rotate in unison but in opposite directions. Simultaneously, cables 32 and 34 wrap around upper and lower wheels B (secondary pulleys) thus causing the limbs to flex.

Figure 8:
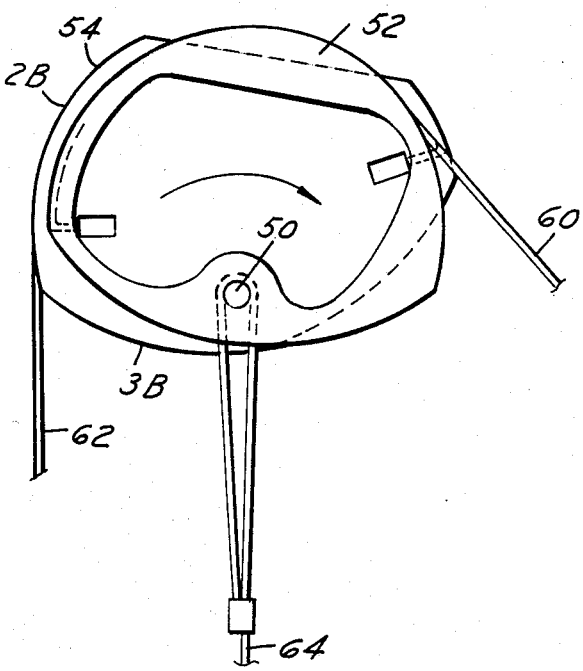

Points A, B, C and D of the force-draw curve (FIG. 2) correspond to the wrapping action of cables 32 and 34 as they wrap around Zones 1B, 2B and 3B of the upper and lower wheel B. Points A to B of the force-draw curve (FIG. 2) corresponds to the rotating action of the pulley assemblies from the starting position (FIGS. 4 and 6), to a position where cables 32 and 34 are just starting to wrap around zone 2B (FIG. 7). Points B to C of the force-draw curve corresponds to the rotating action of the pulley assemblies as cables 32 and 34 wrap around Zones 2B to a position where the cables are just starting to wrap around Zones 3B (FIG. 8). Point C to D of the force-draw curve corresponds to the rotating action of the pulley assemblies as cables 32 and 34 wrap around Zones 3B to a position where cables 32 and 34 are at a minimum distance to the pulley assembly point (40, 50 or P), FIGS. 5 and 9.

The size of Zone 2B determines the amount of cable 32 and 34 which is wrapped around wheels B (and determines the distance between points B and C of force-draw curve) and thus determines the amount of limb flexing and also the amount of bow string 30 that is allowed to be drawn rearward. It is in this manner that the draw length is determined. The size of Zone 2B can be adjusted by manufacturing pulley assemblies that have different size Zones 2B or by interchanging add-on elements which change the size of Zone 2B on the upper and lower pulley assemblies. In any case, Zones 1A, 2A and Zones 1B and 3B always remain substantially the same size. The size of Zone 4B varies inversely as the size of the 2B changes.

In FIGS. 14 to 20, there are illustrated pulley configurations to allow variation in draw length in combination with the doublepulley design previously described. Essentially, three different draw lengths can be achieved with three grooved cam plates illustrated in FIGS. 17, 21 and 22 used in conjunction with a basic compound pulley. The primary pulley 70 (draw string pulley) remains the same but serves as a base plate for the mounting of add-on cam plates.

Figure 14:
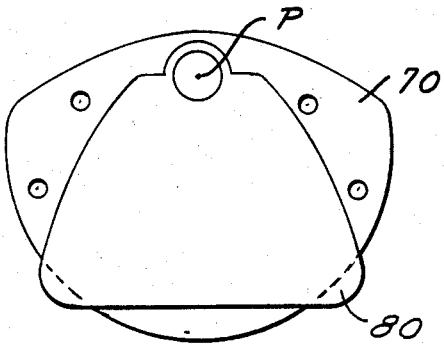
Figure 15:
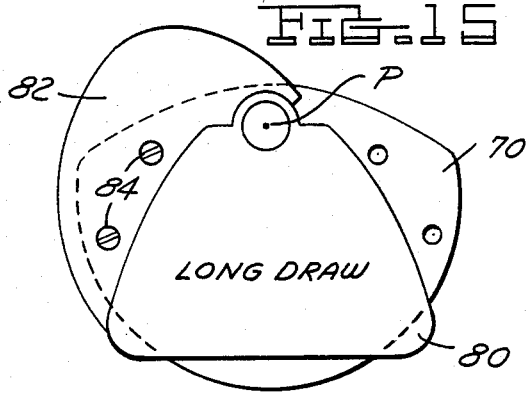
Figure 16:
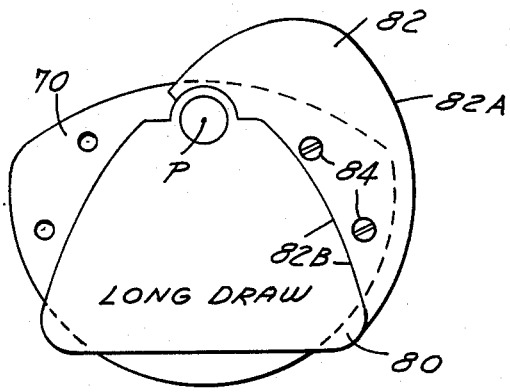
Figure 17:
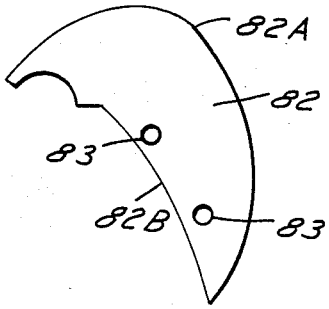

FIG. 14 shows a base compound pulley configuration essentially symmetrical in shape and comprising a base and primary pulley 70, and a secondary or cable pulley 80 mounted for common rotation about a pivot P. In FIG. 17, a small cam plate 82 with mounting holes 83 is illustrated. This plate 82 is shaped like a quarter moon and has a cable groove in its outer periphery 82*a* and can be mounted on the base pulley 70 by screws 84 on the left side of the pivot P (FIG. 15) or the right side of the pivot P (FIG. 16). The inner periphery 82*b* of plate 82 conforms to the periphery of the secondary pulley 80. FIG. 15 illustrates the modification of the upper set of pulleys. FIG. 16 illustrates the modified lower set of pulleys. This modification of the pulleys can extend the draw length of the bow to a long draw, for example, 30" to 32", in a standard size pulley set. Each cam plate has a cable groove on its peripheral edge and is constructed so that the curves at each end blend with the curves of the secondary plate 80 when mounted as shown in FIGS. 15 and 16.

Figure 18:
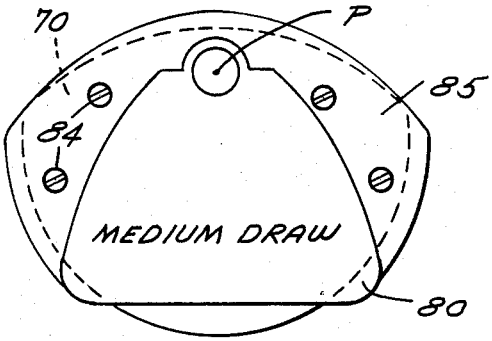
Figure 21:
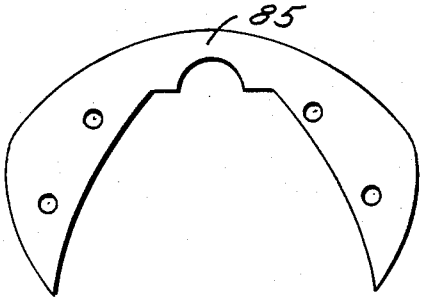

In FIG. 18, a single arcuate-shaped or winged cam plate 85, symmetrical in design, is illustrated. This plate 85 mounts symmetrically in complemental fashion on the base pulley 70 and can be used for both the upper and lower pulley assembly. This will provide a medium draw length, for example, 28" to 30". Plate 85 is illustrated in FIG. 21.

Figure 22:
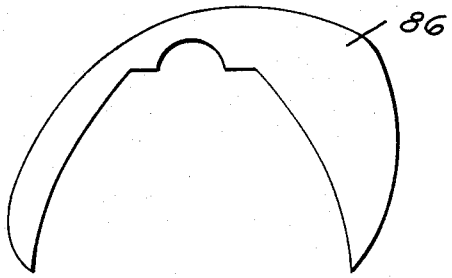
Figure 19:
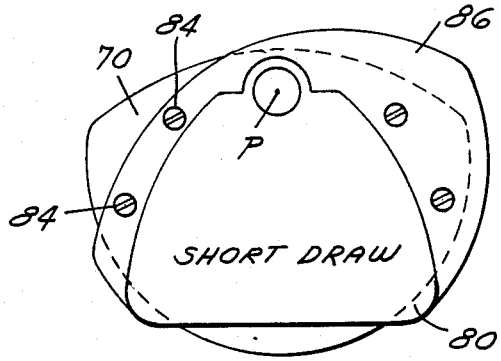
Figure 20:
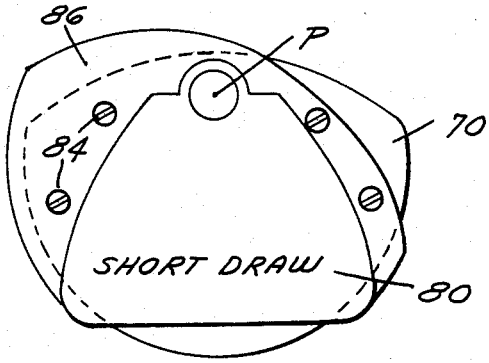

In FIG. 22, a non-symmetrical add-on cam 86 arcuate in shape, but with a bulge on one side, can be added to the upper and lower pulley sets 70–80, respectively, as shown in FIGS. 19 and 20. This will provide a short draw length of, for example, 25" to 27".

In each case, the add-on plate mounts on the primary plate 70 to provide a cable groove in conjunction with the groove of the secondary plate 80. The inner curve of each plate 82, 85 and 86 is shaped to complement the curve of the base plate 80.

If the order is reversed and the configuration of FIG. 15 is placed on the lower pulley set and the configuration of FIG. 16 is placed on the upper pulley set, the draw length will be less than the basic draw as in FIGS. 19 and 20.

The purpose and function of these add-on plate combinations in FIGS. 14 to 22 is to change the shape of segments 2B and 4B illustrated diagrammatically in FIGS. 11, 12 and 13. The changes may be accomplished by the add-on plate combinations illustrated, or the primary and secondary pulleys may be molded in the desired shape as an integral unit.

What I claim is:

1. In a compound shooting bow having a handle section and flexing limbs extending in opposite directions from said handle, each limb having a tip-mounted set of compound pulleys pivoted about a pivot axis, a draw string extending between said pulleys, and cables anchored respectively at each limb tip and passing to pulleys at the other limb tip, that improvement in which each set of compound pulleys comprises:

(a) a primary bow string pulley rotatable on said pivot axis, and (b) a second base cable pulley juxtaposed with said primary pulley rotatable with and on the same axis as said primary pulley, and a plurality of add-on plates mountable on said primary pulley in the plane of said secondary pulley to alter the draw lengths of said bow string.

2. A compound shooting bow as defined in claim 1 in which one of said add-on plates comprises a plate in the shape of a quarter moon.

3. A compound shooting bow as defined in claim 1 in which one of said add-on plates comprises a symmetrical double winged shape having a narrow center and wings which enlarge and ensmall in a direction away from the center.

4. A compound shooting bow as defined in claim 1 in which an arcuate plate having one narrow wing and one enlarged wing which enlarges and ensmalls in a direction away from the center.

5. In a compound shooting bow having a handle section and flexing limbs extending in opposite directions from said handle, each limb having a tip-mounted set of compound pulleys pivoted about a pivot axis, a draw string extending between said pulleys, and cables anchored respectively at each limb tip and passing to pulleys at the other limb tip, that improvement in which each set of compound pulleys comprises:

(a) a primary draw string pulley for said draw string rotatable on said pivot axis having a first circular perimetric section concentric with a first center for essentially 180° of its perimeter and a second connecting curved perimetric section over the remainder of the perimeter having a lesser curvature than said first section, whereby the force-draw curve of said bow has a steep rise, a leveling plateau at peak draw force and a steep descent to the final draw force, (b) the radii of said second perimetric section between said pivot axis and said second section progressively decreasing from each end of said second section to the center point of said second section and being less in dimension than the radius of said first section.

6. In a compound shooting bow having a handle section and flexing limbs extending in opposite directions from said handle, each limb having a tip-mounted set of compound pulleys pivoted about a pivot axis, a draw string extending between said pulleys, and cables anchored respectively at each limb tip and passing to pulleys at the other limb tip, that improvement in which each set of compound pulleys comprises:

(a) a primary draw string pulley for said draw string rotatable on said pivot axis having a first circular perimetric section concentric with a first center for essentially 180° of its perimeter and a second connecting curved perimetric section over the remainder of the perimeter having a lesser curvature than said first section, whereby the force-draw curve of said bow has a steep rise, a leveling plateau at peak draw force and a steep descent to the final draw force, (b) the midpoint of said first and second perimetric sections being on a line connecting said pivot axis and said first center.

7. In a compound shooting bow having a handle section and flexing limbs extending in opposite directions from said handle, each limb having a tip mounted set of compound pulleys pivoted about a pivot axis, a draw string extending between said pulleys, that improvement in which each set of compound pulleys comprises:

(a) a primary draw string pulley for said draw string rotatable on said pivot axis having a first circular perimetric section concentric with the first center for essentially 180° of its perimeter and a second connecting curved perimetric section over the remainder of the perimeter having a lesser curvature than said first section, whereby the force-draw curve of said bow has a steep rise, a leveling plateau at peak draw force and a steep descent to the final draw force, (b) cables anchored respectively at each limb tip and passing to pulleys at the other limb tip, (c) a secondary cable pulley juxtaposed with said primary pulley rotatable with and on the same axis as said primary pulley, each said secondary pulley having anchored at its periphery a cable end, the other end of said cable being anchored at the other end of the bow, each said secondary pulley having four perimetric zones around said pivot axis including:

(d) a first flat zone adjacent the first perimetric section of said primary pulley, a second curved zone essentially concentric with said first center, a third zone curved with respect to said first center having radii from said center to the third zone curve which decrease from the ends to the center of said third zone and which are less in dimension than the radius of the second zone, and a fourth perimetric zone connecting said first and third zones.

8. A compound shooting bow as defined in claim 7 in which the fourth zone is smaller than the second zone to provide a long draw length.

9. A compound shooting bow as defined in claim 7 in which the fourth zone is essentially equal to the second zone to provide a medium draw length.

10. A compound shooting bow as defined in claim 7 in which the second zone is smaller than the fourth zone to provide a short draw.

11. In a compound shooting bow having a handle section and flexing limbs extending in opposite directions from said handle, each limb having a tip-mounted set of compound pulleys pivoted about a pivot axis, a draw string extending between said pulleys, and cables anchored respectively at each limb tip and passing to pulleys at the other limb tip, that improvement in which each set of compound pulleys comprises:

(a) a primary bow string pulley rotatable on said pivot axis, (b) a secondary cable pulley juxtaposed with said primary pulley rotatable with and on the same axis as said primary pulley, (c) said primary and second pulleys being shaped to provide a draw length-draw force curve rising steeply from zero to a leveling off section providing a plateau section in the curve and then dropping steeply to a hold force position, (d) said primary draw string pulley having a first circular perimetric section concentric with a first center for essentially 180° of its perimeter and a second connecting curved perimetric section over the remainder of the perimeter having a lesser curvature than said first section, and said secondary cable pulley being juxtaposed with said primary pulley rotatable with and on the same axis as said primary pulley, each said secondary pulley having anchored at its periphery a cable end, the other end of said cable being anchored at the other end of the bow, each said secondary pulley having four perimetric zones around said pivot axis including:

a first flat zone adjacent the first perimetric section of said primary pulley, a second curved zone essentially concentric with said first center, a third zone curved with respect to said first center having radii from said center to the third zone curve which decrease from the ends to the center of said third zone and which are less in dimension than the radius of the second zone, and a fourth perimetric zone connecting said first and third zones.

* * * * *